US007625227B1

(12) United States Patent
Henderson et al.

(10) Patent No.: US 7,625,227 B1
(45) Date of Patent: Dec. 1, 2009

(54) HIGH PERFORMANCE BLIND-MATE CONNECTOR

(75) Inventors: David Henderson, Santa Rosa, CA (US); Sean P. Cortright, Santa Rosa, CA (US); Calvin Krug, Santa Rosa, CA (US); Ryan Kelley, Santa Rosa, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/888,230

(22) Filed: Jul. 31, 2007

(51) Int. Cl.
*H01R 13/627* (2006.01)

(52) U.S. Cl. ..... 439/350; 439/353

(58) Field of Classification Search ..... 439/350, 439/352–3, 357–8
See application file for complete search history.

(56) References Cited

U.S. PATENT DOCUMENTS 3,452,316 A * 6/1969 Mocek et. al. ..... 439/255
6,695,636 B2 * 2/2004 Hall et al. ..... 439/352
6,848,931 B2 * 2/2005 McMullen et al. ..... 439/350

* cited by examiner

*Primary Examiner*—Edwin A. Leon
*Assistant Examiner*—Vanessa Girardi

(57) ABSTRACT

A two-part connector can be achieved for high performance situations using blind-mate insertion by using power activation. In one embodiment, the male and female portions of a standard RF connector can be securely mated so as to achieve high performance without the need for a screw type locking mechanism. Power activation is achieved, in one embodiment, by pneumatic actuation of a piston having fingers which engage an outer edge of a housing formed around the female portion of the connector so as to pull the female portion into a tight mating relationship with the male portion.

20 Claims, 5 Drawing Sheets

HIGH PERFORMANCE BLIND-MATE CONNECTOR

TECHNICAL FIELD

This disclosure relates to high performance connectors and more particularly to a high performance non-screw type connector having blind-mating capabilities and even more particularly to a blind-mate high performance RF connector.

BACKGROUND OF THE INVENTION

Radio Frequency (RF) connectors are used in a number of situations for the transfer of high frequency signals across a separable connection. In some high performance applications, such as, for example, testing situations where high reliability is required, RF junction points must serve to transfer the RF signals without leakage, attenuation or discontinuity and without changing electrical characteristics. The problem is compounded when the connection is desired to be made by a single insertion of one portion of the connector to the other without requiring the connector portions to be screwed together.

In a typical high performance RF connection, one portion of the connector is screwed to the other. The screw mechanism imparts significant continuous mating pressure (sometimes in the order of several hundred pounds) on the connector portions causing them to remain firmly mated thereby yielding high reliability.

In some situations, such as, for example, when robots bring the portions of the connector together, it is desired to insert the male portion into the female portion with a straight-line motion. This straight-line motion enables blind-mating of the connector by eliminating the necessity for performing a circular screwing motion which would be necessary if the mating elements were to be screwed together. However, simply inserting the two portions together will not insure high performance because in such situations the respective connector portions can back away from one another or otherwise change their orientation, forming discontinuities and/or RF leakage.

BRIEF SUMMARY OF THE INVENTION

A two-part connector can be achieved for high performance situations using blind-mate insertion by using power activation. In one embodiment, the male and female portions of a standard RF connector can be securely mated so as to achieve high performance without the need for a screw type locking mechanism. Power activation is achieved, in one embodiment, by pneumatic actuation of a piston having fingers which engage an outer edge of a housing formed around the female portion of the connector so as to pull the female portion into a tight mating relationship with the male portion.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
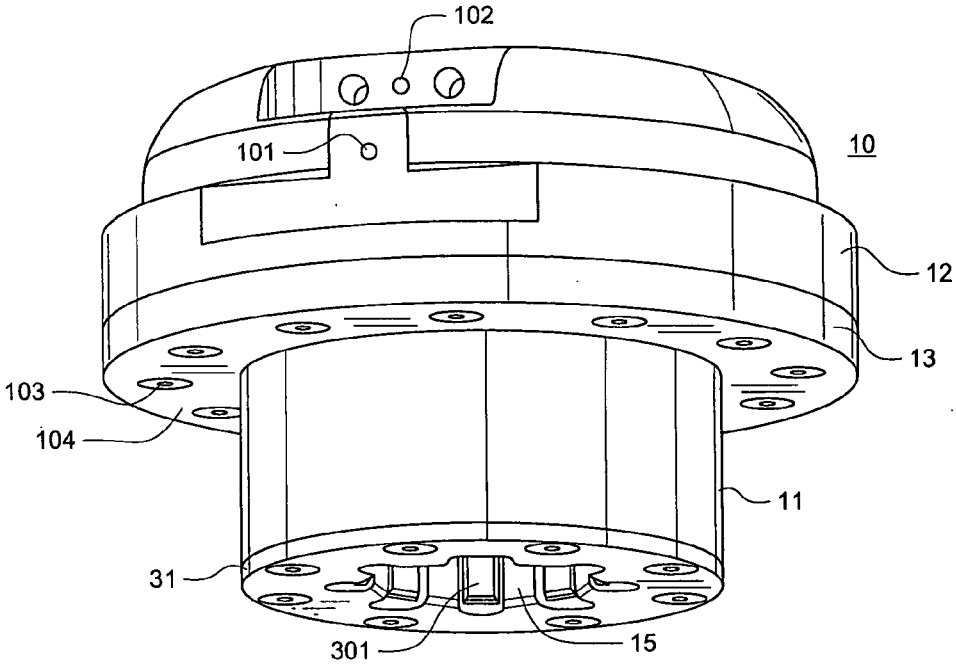
FIGS. 1 and 2 show embodiments of a blind-mate connector pair in accordance with the teaching of the inventive concepts.
Figure 2:
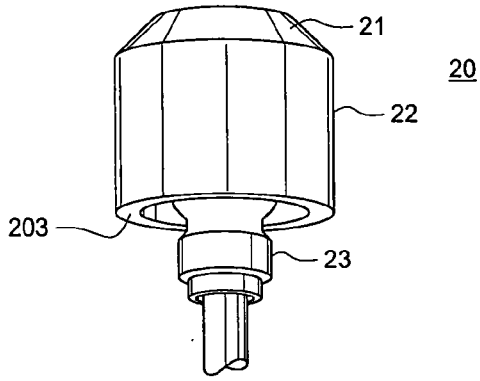

FIGS. 1 and 2 show embodiments of a blind-mate connector pair in accordance with the teaching of the inventive concepts. FIG. 1 shows one portion of the connector 10 in which the male portion (shown in subsequent FIGURES) of a standard RF connector is positioned. Connector 10 is constructed with crown 12 and post 11. In the embodiment shown, the crown and post are circular but this is essentially a matter of esthetics and any shape can be employed. In situations where connector 10 is to be mounted in a fixed position with respect to another structure, such as would be necessary when a robot is used to mate the female portion of the connector (shown in FIG. 2), ledge 104, formed by crown 12 having a larger circumference in the embodiment shown than does post 11, can be used to secure the fixed relationship. In one embodiment, this is accomplished by positioning ledge 104 against a flat surface (not shown) and using fasteners (not shown) through holes in the flat surface. The fasteners would engage screw sockets 103.

The crown and post assembly can be constructed using two major portions, such that portion 13 can be rigidly affixed to post 11. Portion 13 can then be attached to crown 12 by gasket 320 (shown in FIG. 3). Two air inlets are shown in crown 10, with inlet 101 allowing air into a port (shown in FIG. 3) for engaging (as will be described) the female connector portion. Air inlet 102 is used for releasing the engagement. Note that while pneumatics is used in this embodiment, the concepts discussed herein can be used with hydraulics and/or electrical energy or a combination thereof. Note also that in some embodiments, a spring mechanism could be used to apply either the engagement or disengagement control force. Fingers 301 are used, as discussed hereinafter, to grasp distal end 203 of shell 22 of connector 20 (FIG. 2) under control of engagement force provided via air inlet 101.

FIG. 2 shows a second portion of connector 20 of the connector pair in which female portion 23 (shown more clearly in FIG. 3) a standard RF connector is positioned within shell 22. Shell 22 has, in one embodiment, sloping portion 21 used, as will be seen to facilitate shell 22 sliding into passageway 15 of connector portion 10 when connector 20 is positioned for insertion in mating relationship with connector 10.

Figure 3:
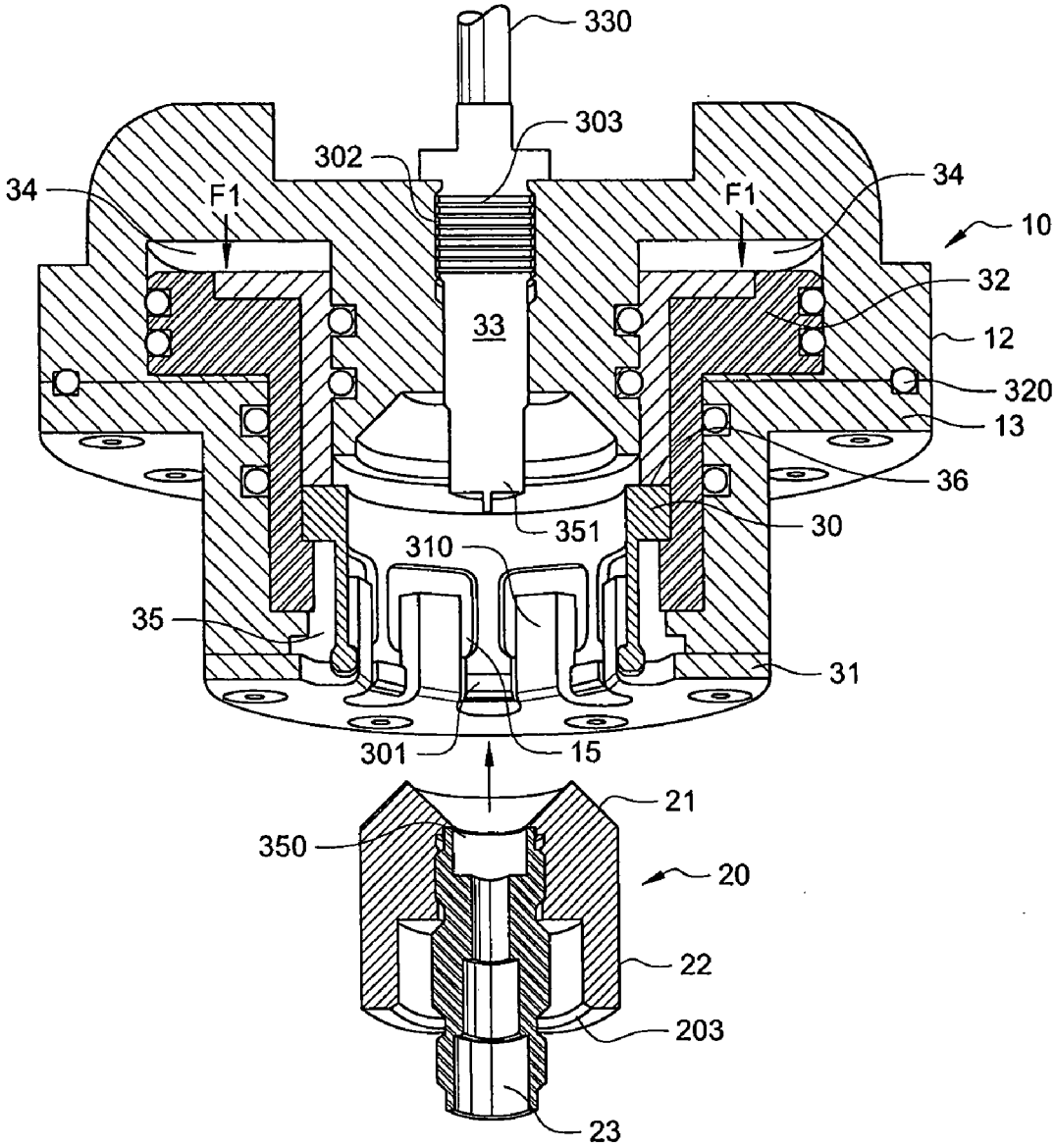
FIGS. 3, 4 and 5 show in cut-away form various stages of mating with respect to the embodiments shown in FIGS. 1 and 2.
Figure 4:
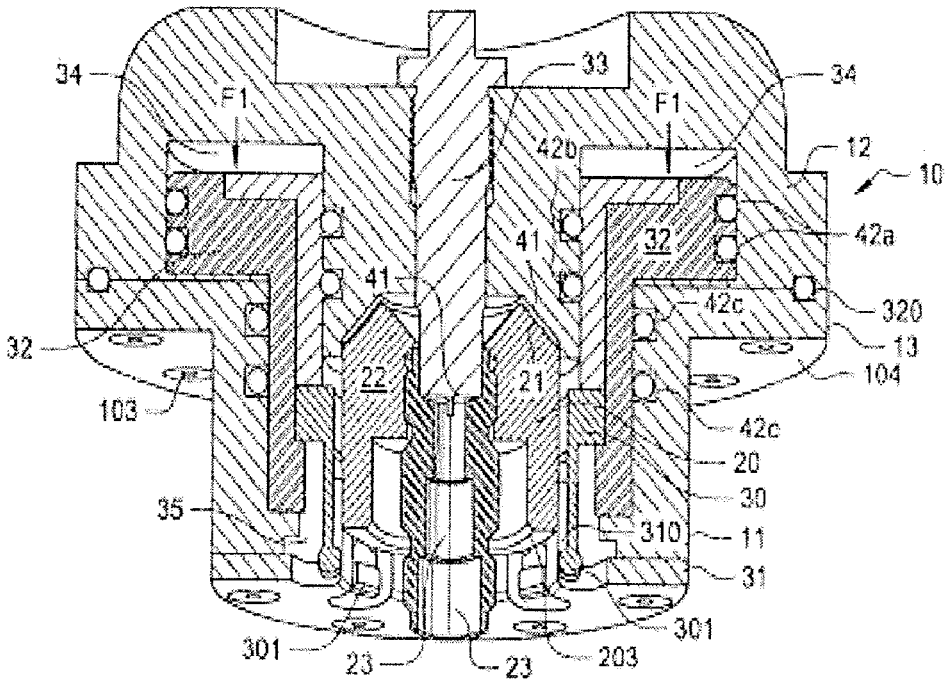
Figure 5:
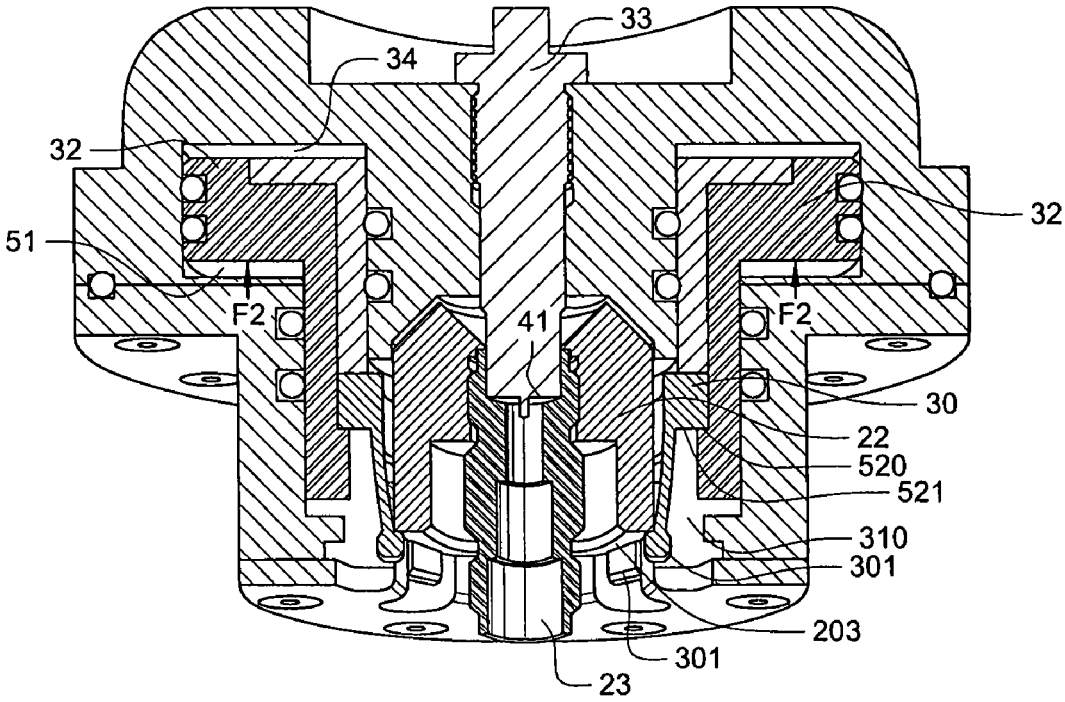

FIGS. 3, 4 and 5 show in cut-away form various stages of mating with respect to the embodiments shown in FIGS. 1 and 2. FIG. 3 shows connector 20 coming into mating relationship with passageway 15 of connector 10. The object of the full mating process is to have proximal end 351 of male RF connector 33 inserted into female end 350 of RF connector 23 and held in mated relationship for as long as necessary.

In operation, shell 22 surrounding connector 23 slides inside passageway 15. This is facilitated by pressure applied by force F1 pushing downward (toward the open end of passageway 15). Force F1 can be generated by air forced into chamber 34 above piston 32. When piston 32 moves toward the open end of passageway (also called slideway) 15, gripping collet 30 is pushed downward which in turn (as will be discussed move fully with respect to FIG. 6) allows collet fingers 301 to move away (back) from the center axis of the passageway and behind (as viewed from the center axis) interspersed fingers 310 of slip bushing 31. As will be seen, this "opening" action on the part of fingers 301 is facilitated by cam bushing 35. This then opens passageway 15 so as to allow the other surface of shell 22 to slide within the passageway. Shell 22 has an inner surface designed to rigidly grip and hold female RF connector 23.

FIG. 4 shows RF connector portion 23 almost fully mated with RF connector portion 33. Note that slope 21 of shell 22 is almost mated with slope 41 of passageway 15. Note also that distal end 203 of shell 22 has now passed the ends of fingers 301 of gripping collet 30. During the movement of shell 22 within passageway 15, force F1 was maintained both by air continually being forced into cavity 34 and maintained therein with the aid of o-rings 42A, 42B and 42C.

FIG. 5 shows force F1 having been released and force F2 (in this embodiment being air forced into the bottom portion 51 of cavity 34) which serves to push piston 32 upward (away from the open end of passageway 15). Lip 520 of piston 32 engages overhang 521 of finger support 30 which in turn pulls fingers 301 upward along the passageway. Lips 60 (shown in FIG. 6) at the ends of fingers 301 grip distal end 203 of shell 22 such that continued upward movement of piston 32 forces shell 22 upward toward male RF connector 23. Force F2 can be maintained as long as desired thereby applying pressure between the male and female RF connector portions so as to maintain a firm reliable contact therebetween.

Figure 6:
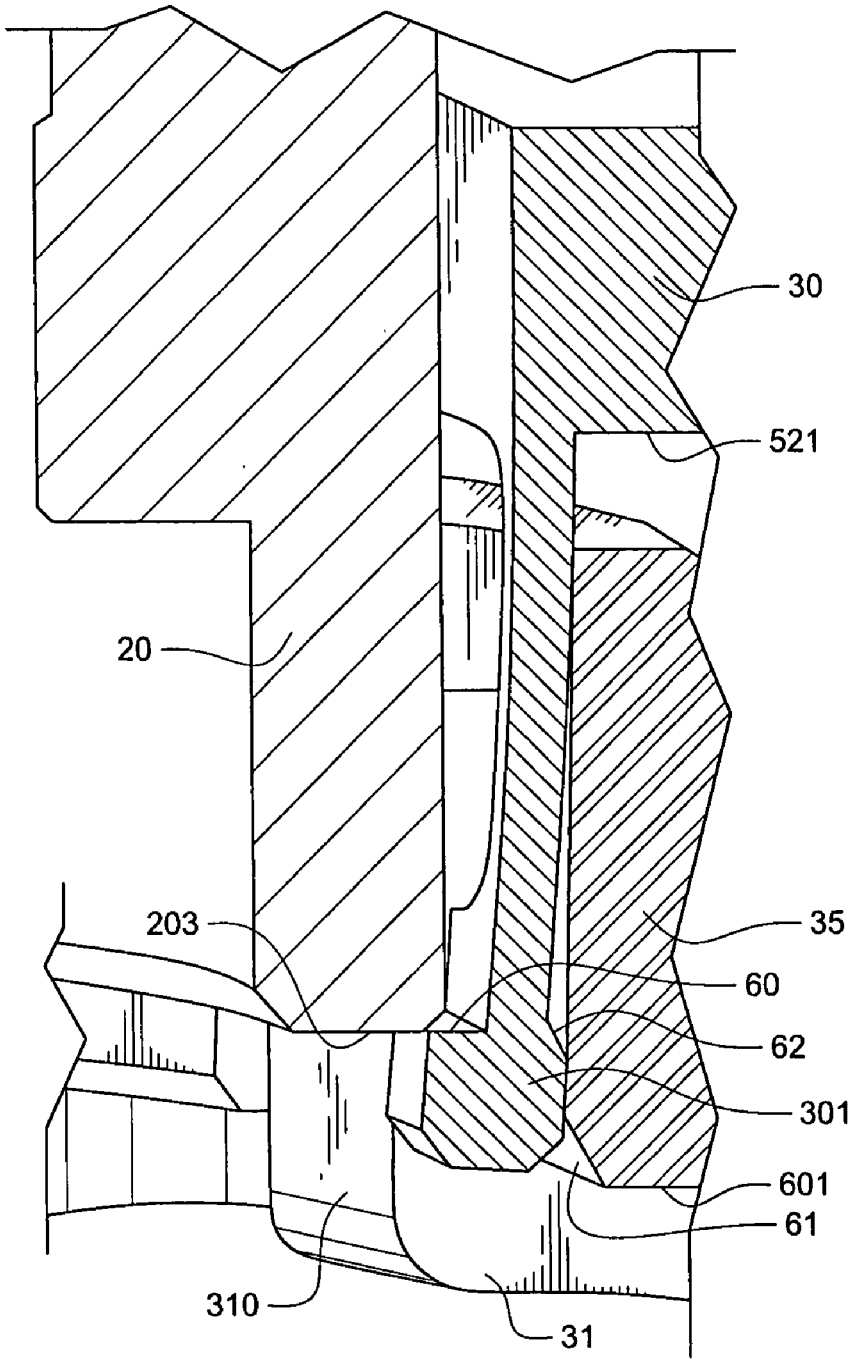
FIG. 6 shows an expanded view of one embodiment of a grasping arrangement employed with respect to the embodiments of FIG. 1.

FIG. 6 shows a blown-up cutaway of fingers 301 with lip 60 contacting end 203 of shell 22. Cam bushing 35 is constructed such that when finger 301 is extended (under force F1) the finger end rests under end 601 of the cam bushing. When finger 301 begins moving upward then chamfer 61 of the cam bushing working with chamfer 62 of finger 301 forces finger end out from behind interspersed finger 310 of slip bushing 31 and into gripping contact with distal end 203 of shell 22. Finger 301 is thus controllably extended into the guideway. As finger 301 continues to be drawn inside passageway 15 by the upward movement of piston 32 operating from force F2, the mating relationship between connector portions 23 and 33 can be selectively controlled and maintained as desired. Note that while a chamfer on a bearing surface is shown, any number of mechanisms can be used to controllably extend one or more fingers or lips under the outer end of connector 20 to force completion of the mated relationship. For example, a pivoting lever could be used as could pins forced upward by air hydraulic or pneumatic pressure.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A two-part in-line RF connector, comprising:

a first portion;

a passageway within said first portion, said passageway having a distal end and a proximal end, wherein said proximal end is configured to receive a second portion of said RF connector;

a piston having a portion thereof slideable along a longitudinal axis of said passageway;

a gripping collet positioned within said passageway and moveable along said longitudinal axis under control of said piston, said collet having fingers positioned facing said proximal end of said passageway; and means for controllably expanding and contracting said fingers within said passageway.

2. The two-part in-line RF connector of claim 1 wherein said extending means comprises;

a slip bushing for protecting said fingers when said fingers are not extended; and a cam bushing for forcing said fingers to extend into said passageway as said collet moves toward said distal end of said passageway.

3. The two-part in-line RF connector of claim 2 further comprising:

at least one opening for accepting forces applied from external of said apparatus, said forces selectably controlling movement of said piston.

4. The two-part in-line RF connector of claim 3 wherein a portion of said slip bushing forms an outer end of said passageway at said proximal end of said passageway.

5. The two-part in-line RF connector of claim 4 wherein said first portion comprises: said at least one opening; and said second portion comprises: said passageway; said collet within said passageway; and said slip bushing; and wherein said piston extends between said first and second portions.

6. The two-part in-line RF connector of claim 5 wherein said second portion has an outside circumference less than an outside circumference of said first portion.

7. The two-part in-line RF connector of claim 5 wherein said inside circumference of said collet within said passageway is such as to form a slip fit with an outside circumference with a collar surrounding at least a portion of said second portion of said RF in-line connector.

8. A method of securing two portions of a connector in mating relationship with each other, said method comprising:

positioning a first portion of said connector into mating relationship with a second portion of said connector, said positioning comprising inserting a shell formed at least partially around said first portion such that an outer surface of said shell comes into sliding contact with an inner surface of a passageway positioned in front of said second portion of said connector;

grasping a portion of said shell after said shell has passed a certain distance along said passageway, said grasping being controlled, at least in part, by force applied by the movement of a piston, a portion of which is positioned within said passageway; and pulling said first and second portions into a sustained mated relationship with each other under control of said applied piston force.

9. The method of claim 8 wherein said grasping comprises:

opening a set of fingers, said fingers extending along a longitudinal axis of said shell; and closing said fingers such that gripping ends of said fingers lock around a distal end of said shell.

10. The method of claim 8 wherein said passageway forms a straight-line passage from an opening in said passageway to an end of said second portion of said connector.

11. The method of claim 8 wherein said first portion of said connector is a female portion of a standard RF connector and wherein said second portion of said connector is a male portion of a standard RF connector.

12. The method of claim 8 wherein said applied piston force comprises, at least in part:

application of external force to said connection.

13. The method of claim 12 wherein said external force is provided by one of the following energy sources: pneumatic, hydraulic, electrical.

14. A system for securing two portions of a connector in mating relationship with each other, said system comprising:

means for bringing a first portion of said connector into mating relationship with a second portion of said connector, said means for bringing comprising a passageway for allowing a shell formed at least partially around said first connector portion to slide within said passageway;

means positioned within said passageway for grasping a portion of said shell after said shell has passed a certain distance along said passageway;

a piston having at least a portion within said passageway;

means for activating said means positioned within said passageway under control of said piston; and means controlled by said piston for pulling said first and second portions into a sustained mated relationship with each other.

15. The system of claim 14 further comprising:

means for applying external force to said piston.

16. The system of claim 15 wherein said external force is provided by one of the following energy sources: pneumatic, hydraulic, electrical.

17. The system of claim 15 wherein said grasping means comprises:

means for opening and closing a set of fingers, said fingers extending along a longitudinal axis of said passageway.

18. The system of claim 17 wherein said opening and closing means comprises:

a cam bushing; and a slip bushing; and wherein said grasping means comprises a plurality of longitudinally extending fingers and wherein said slip bushing protects said fingers from contact with said shell while said shell is slides along at least a portion of said passageway.

19. The system of claim 18 wherein said grasping means further comprises:

a cam bushing for forcing said grasping means against said shell as said piston withdraws within said passageway.

20. The system of claim 17 wherein said first portion of said connector is a female portion of a standard RF connector and wherein said second portion of said connector is a male portion of a standard RF connector.

* * * * *